US006688949B2

(12) United States Patent
Shinbo et al.

(10) Patent No.: US 6,688,949 B2
(45) Date of Patent: Feb. 10, 2004

(54) METHOD AND APPARATUS FOR SURFACE TREATMENT OF INNER SURFACE OF MEMBER

(75) Inventors: Yoshinori Shinbo, Okaya (JP); Koichi Saito, Okaya (JP); Toshikazu Hayakawa, Okaya (JP)

(73) Assignee: Kyoei Denko Co., Ltd., Okaya (JP)

( * ) Notice: Subject to any disclaimer, the term of this patent is extended or adjusted under 35 U.S.C. 154(b) by 0 days.

(21) Appl. No.: 09/989,185

(22) Filed: Nov. 21, 2001

(65) Prior Publication Data

US 2002/0119738 A1 Aug. 29, 2002

(30) Foreign Application Priority Data

Dec. 26, 2000 (JP) ..... 2000-394430
Sep. 21, 2001 (JP) ..... 2001-288793

(51) Int. Cl.[7] ..... B24B 1/00
(52) U.S. Cl. ..... 451/51; 451/27
(58) Field of Search ..... 451/51, 32, 27, 451/28

(56) References Cited

U.S. PATENT DOCUMENTS 4,461,126 A * 7/1984 Bowman ..... 451/32
6,036,580 A * 3/2000 Igelshteyn et al. ..... 451/36

FOREIGN PATENT DOCUMENTS

JP 7-40226 * 2/1995 ..... B24B/31/112

* cited by examiner

*Primary Examiner*—Dung Van Nguyen
(74) *Attorney, Agent, or Firm*—Westerman, Hattori, Daniels & Adrian, LLP

(57) ABSTRACT

The present invention provides a method and an apparatus for surface treatment to polish and wash with high accuracy the inner surface of a member having complicated internal configuration.

A magnet 23 is arranged on outer side of a member 1, which is made of a nonmagnetic material and for which surface treatment is to be performed on inner surface. Magnetic grains and abrasive grains in slurry state are supplied to inner surface of the member. At least one of the member 1 and the magnet 23 is rotated and are relatively moved in axial direction at the same time.

7 Claims, 11 Drawing Sheets

METHOD AND APPARATUS FOR SURFACE TREATMENT OF INNER SURFACE OF MEMBER

BACKGROUND OF THE INVENTION

The present invention relates to a method and an apparatus for surface treatment such as polishing, washing, etc. of inner surface of a member, which has complicated internal configuration.

For instance, a flexible tube used to supply raw materials or processing solution to a system such as semiconductor manufacturing system is made of a nonmagnetic material such as stainless steel. By forming concave and convex portions continuously on outer and inner peripheries of the tube, a flexible tube freely bendable can be manufactured. On inner surface of the flexible tube, a multiple of micro-projections in the order of micron in size are formed in the molding process. If this is used without additional processing, foreign objects are accumulated between the projections. Then, these foreign objects are intermingled into the raw materials and the processing solution, and this gives adverse effects to the manufacture of semiconductor products.

In this respect, it is proposed in JP-A-7-40226 that a pair of magnets is arranged at opposed positions on outer periphery of the flexible tube. Magnetic abrasive grains in slurry state are filled in the flexible tube. By rotating the magnet and by moving the flexible tube in axial direction, projections on inner surface of the flexible tube are polished and processed by surface treatment.

FIG. 12 and FIG. 13 each represents the conventional method for surface treatment as described above. FIG. 12(A) is a schematical drawing to show the arrangement, FIG. 12(B) is a diagram of magnetic lines of force. In FIG. 12, when a pair of magnets 2*a* and 2*b* are disposed at opposed positions on outer periphery of the flexible tube 1, it is arranged in such manner that each of magnetic poles of the magnets 2*a* and 2*b* faces to the pole of opposite polarity (S-N), i.e. it will be magnetic field for attraction, and the magnetic abrasive grains 3 in slurry state are filled in the flexible tube 1. In this way, when magnetic field for attraction is applied on the magnetic abrasive grains 3 in the flexible tube 1, the magnetic abrasive grains 3 form magnetic brushes on the troughs 1*a* of the flexible tube 1. Thus, the projections at the troughs 1*a* can be ground and polished, while it is difficult to grind and polish the projections on the crests 1*b*. As shown in FIG. 12(B), the rate of change in the magnetic field is low, and fabrication pressure at the polishing site is low. It is impossible to polish with accuracy of 1 $\mu$m or less.

To solve the above problems, it is described in JP-A-7-40226 as described above that the magnets 2*a* and 2*b* are arranged to have the magnetic poles of the same polarity facing to each other (N-N), i.e. it will be a repellent magnetic field. When it is arranged in this manner, the rate of change of the magnetic field is high as shown in FIG. 13(B) and fabrication pressure at the polishing site is high, and it is possible to polish with accuracy of Ry 0.7 $\mu$m or less. However, when diameter of the flexible tube 1 is smaller, the magnetic abrasive grains 3 form magnetic brushes between the adjacent crests 1*b* of the flexible tube 1. As a result, the projections on the crests 1*b* can be ground and polished, while it is difficult to grind and polish the projections on the troughs 1*a* (See Table 1).

The above problems are not limited to the flexible tube but are common to all cases when surface treatment such as polishing, washing, etc. is performed on inner surface of a member having complicated internal configuration.

To solve the above problems, it is an object of the present invention to provide a method and an apparatus for surface treatment of inner surface of a member, by which it is possible to polish and wash with high accuracy the inner surface of a member having complicated internal configuration.

SUMMARY OF THE INVENTION

To attain the above object, the method for surface treatment of inner surface of a member according to the present invention is characterized in that a magnet is arranged on outer side of a member, made of a nonmagnetic material and having inner surface to be processed by surface treatment, magnetic grains and abrasive grains in slurry state are supplied on inner surface of the member, and at least one of the member and the magnet is rotated and relatively moved in axial direction at the same time.

Also, the apparatus for surface treatment of inner surface of a member according to the present invention comprises a plurality of sets of motors for magnet driving and magnetic pole units arranged on an inclined surface, a positioning member mounted on each of the magnetic pole units, a motor for pipe driving mounted on tip of an arm of a robot, a guide pipe penetrating each of the magnetic pole units and positioning members and connected to the motor for pipe driving, a flexible tube inserted into the guide pipe, and magnetic grains and abrasive grains in slurry state filled in the flexible tube.

BRIEF DESCRIPTION OF THE DRAWINGS

FIG. 12(A) is a schematical drawing to show an arrangement, and FIG. 12(B) shows magnetic lines of force; FIG. 13(A) is a schematical drawing to show an arrangement, and FIG. 13(B) shows magnetic lines of force.

DETAILED DESCRIPTION OF THE PREFERRED EMBODIMENTS

Figure 1:
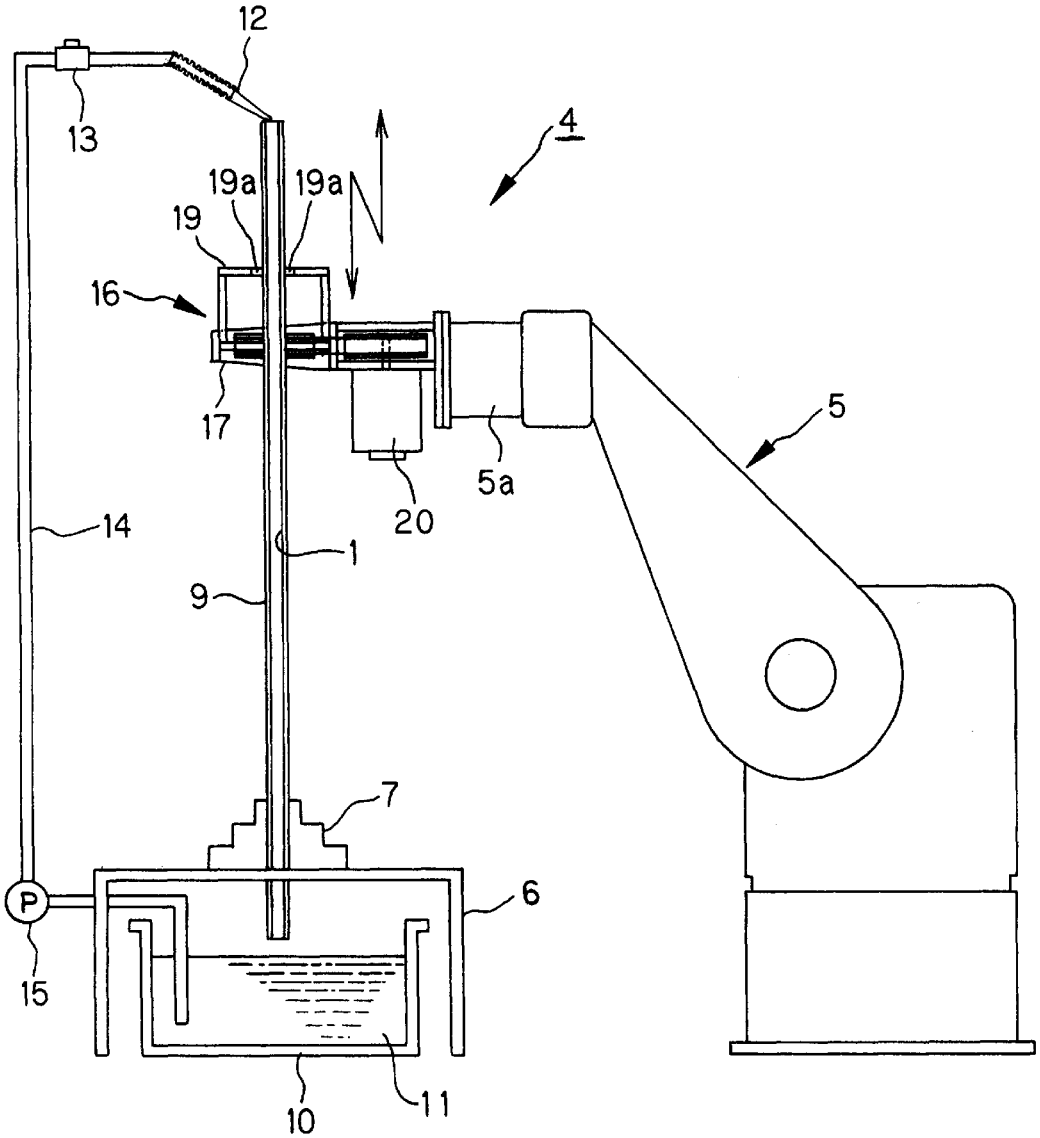
FIG. 1 shows an embodiment of a surface treatment method for inner surface of a member according to the present invention, and it is a side view showing a partial cross-section of a surface treatment apparatus.
Figure 2:
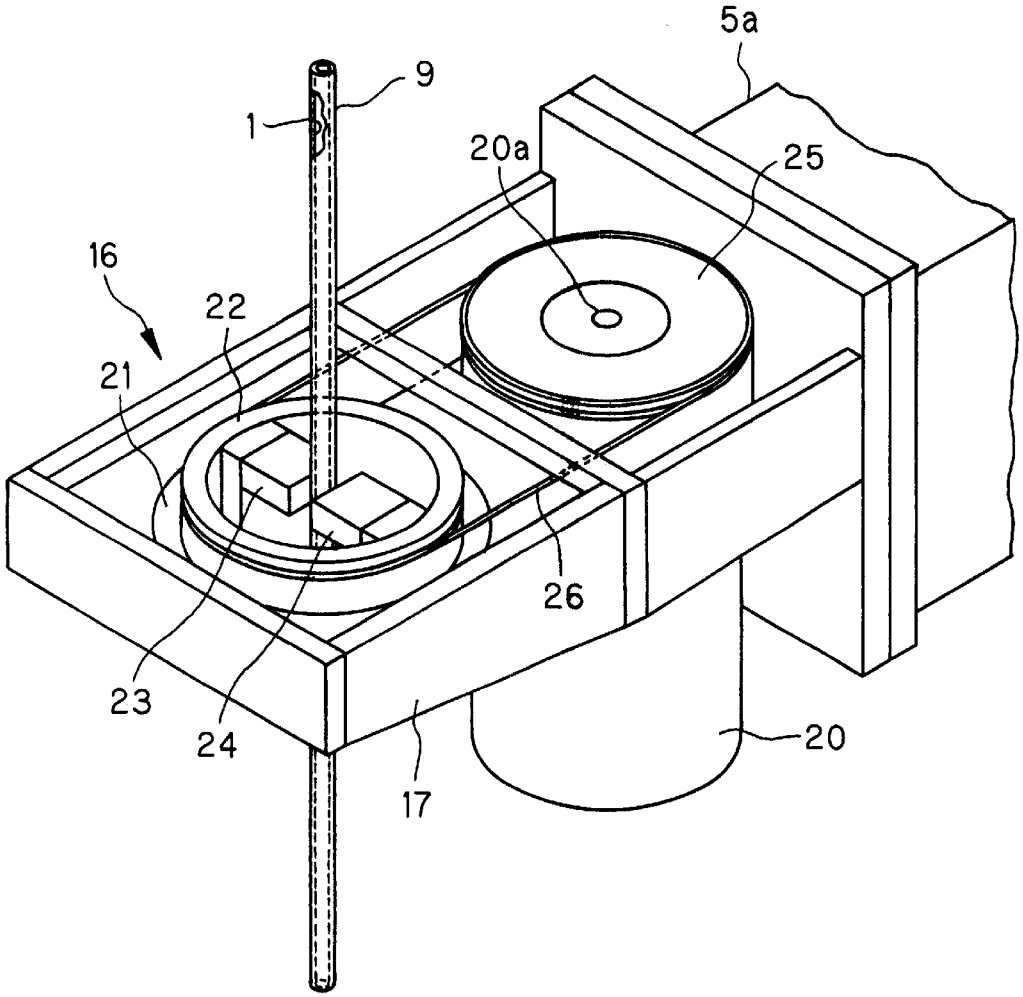
FIG. 2 is an enlarged perspective view of a magnetic pole unit of FIG. 1.
Figure 3A:
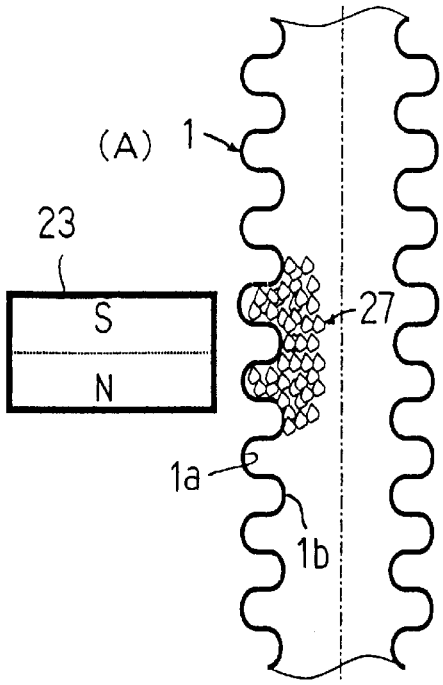
FIG. 3(A) shows an arrangement of the magnet in FIG. 2.
Figure 3B:
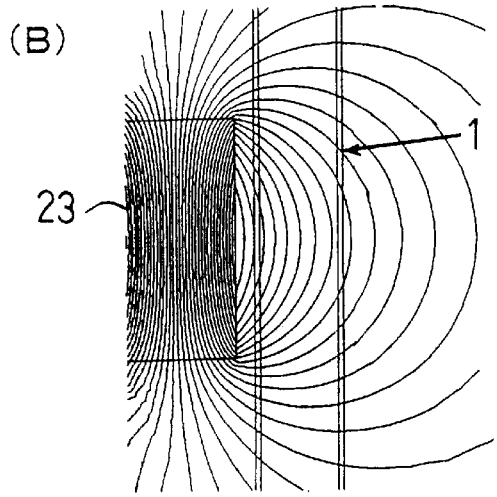
FIG. 3(B) is a diagram showing magnetic lines of force.

Description will be given below on embodiments of the present invention referring to the drawings. FIG. 1 to FIG. 3 each represents an embodiment of a method for surface treatment of inner surface of a member according to the present invention. FIG. 1 is a side view showing partial cross-section of an apparatus for surface treatment, FIG. 2 is an enlarged perspective view of a magnetic pole unit shown in FIG. 1, FIG. 3(A) shows an arrangement of the magnet, and FIG. 3(B) is a diagram showing magnetic lines of force.

In FIG. 1, a surface treatment apparatus 4 according to the present invention comprises a robot 5 and a support stand 6. On the support stand 6, a guide pipe 9 made of an nonmagnetic material is fixed by a fixture 7. A flexible tube 1 (shown in detail in FIG. 2) made of a nonmagnetic material is passed through and supported in the guide pipe 9. An arm 5*a* of the robot 5 is freely movable in a 3-dimensional space of internal mechanism.

Under the support stand 6, an abrasive grain tank 10 is disposed. In the abrasive grain tank 10, abrasive grains 11 in slurry state are filled, which comprise grains such as diamond, alumina oxide, silicon nitride, etc. mixed together in oil. A feeding nozzle is arranged and connected to upper portion of the guide pipe 9, and it is connected to inner space of the abrasive grain tank 10 via an opening valve 13, a feeding pipe 14, and a pump 15.

A frame 17 of a magnetic pole unit 16 is mounted on the arm 5*a* of the robot 5, and the magnetic pole unit 16 is designed to freely move along the guide pipe 9. On the frame 17, a positioning member 19 for supporting the guide pipe 9 is provided. A roller 19*a* is arranged at the tip of the positioning member 19 and is supporting the guide pipe 9. By this positioning member 19, a gap is maintained between magnets (to be described later) and the guide pipe 9.

Next, description will be given on the magnetic pole unit 16 referring to FIG. 2. The magnetic pole unit 16 comprises the frame 17, a motor 20 for magnetic driving an a support member 21 attached on the frame 17, a rotary member 22 in cylindrical shape and movably mounted on the support member 21, and a magnet 23 and a balancer 24 fixed at opposed positions on inner side of the rotary member 22. A driving belt 26 is stretched between a driving pulley 25 fixed on a rotation shaft 20*a* of the motor and the rotary ember 22. The rotary member 22 and the balancer 24 are made of nonmagnetic material. The guide pipe 9 is arranged at the center of the rotary member 22.

As shown in FIG. 3(A), the magnet 23 is arranged with N pole and S pole positioned in axial direction of the flexible tube 1. Magnetic grains 27 in powder state or each in cylindrical shape made of magnetic material such as iron, nickel, or stainless steel under special treatment are placed in the flexible tube 1. Grain size of the magnetic grains 27 is preferably within the range of 0.1–1.5 mm. As shown in FIG. 3(B), magnetic lines of force are running nearly in parallel to the wall of the flexible tube 1, and the rate of change of magnetic field is increased. As a result, the abrasive grains 27 are continuously arranged on troughs 1*a* and crests 1*b* of the flexible tube 1 and are firmly attached on them.

Figure 4A:
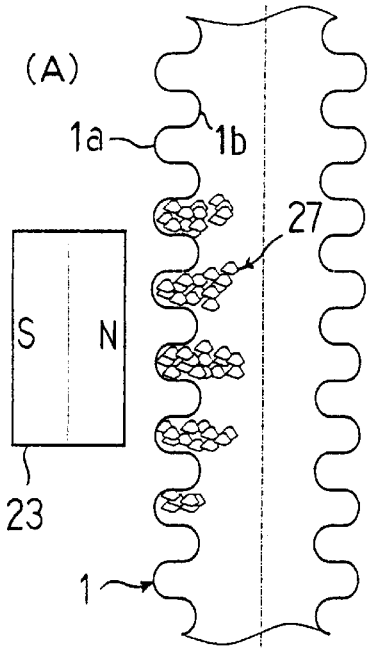
FIG. 4(A) shows a comparative example of arrangement of the magnet.
Figure 4B:
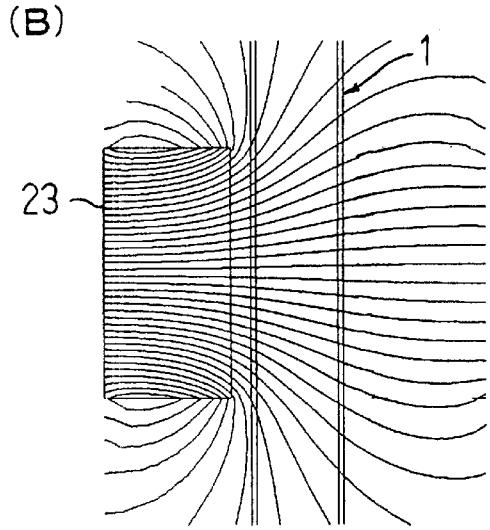
FIG. 4(B) is a diagram of magnetic lines of force.

FIG. 4(A) shows a comparative example of arrangement of the magnet, and the magnets 23 are arranged in such manner that N pole and S pole are aligned in radial direction of the flexible tube 1. In this case, as shown in FIG. 4(B), the magnetic lines of force are running perpendicularly to the wall of the flexible tube 1, and the rate of change in magnetic field is low. The magnetic grains 27 are attached only to the troughs 1*a* of the flexible tube 1. Therefore, as shown in FIG. 3(A), it is important in the present invention to arrange the magnets in such manner that N pole and S pole are positioned in axial direction of the flexible tube 1.

Figure 5:
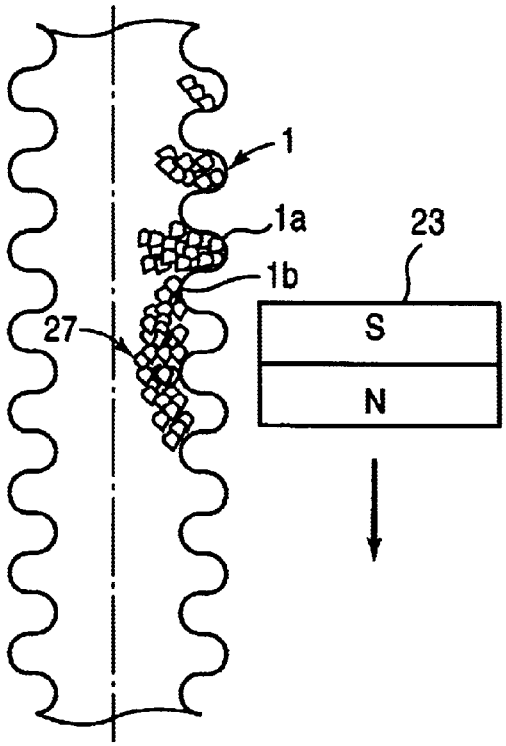
FIG. 5 is a drawing to explain a surface treatment method of the present invention.

Next, description will be given on a surface treatment method using the surface treatment apparatus with the arrangement as described above. After the flexible tube 1 is inserted into the guide pipe 9, the guide pipe 9 is set on the support stand 6. As shown in FIG. 3(A), the magnetic grains 27 are placed in the flexible tube 1, and the abrasive grains 11 in slurry state are supplied into the flexible tube 1 via the feeding nozzle 12, and the magnets 23 are rotated around the flexible tube 1 by the motor 20 for magnet driving (number of revolutions: approx. 1400 rpm). Then, the magnetic grains 27 and the abrasive grains in slurry state supported between the magnetic grains are moved along the troughs 1*a* and the crests 1*b* of the flexible tube 1, and the surfaces of the troughs 1*a* and the crests 1*b* are ground and polished by the abrasive grains in slurry state. At the same time, the magnets 23 are vibrated in axial direction (directions shown by arrows in FIG. 1) at very low speed using the robot 5. Then, as shown in FIG. 5, the magnetic grains 27 are moved from the troughs 1*a* to the crests 1*b*, and polishing can be performed with higher accuracy. When polishing is completed at a site, the magnetic pole unit 16 is moved by the robot 5 to another site, and polishing is carried out in the same manner.

Figure 7:
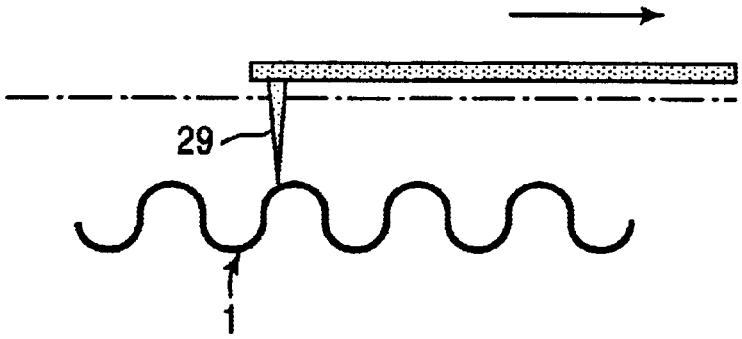
FIG. 7 represents results of experiment based on the surface treatment method of the present invention.
Figure 7:
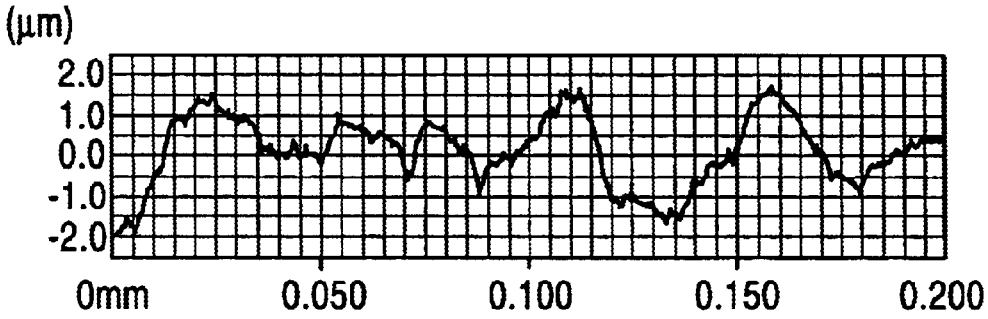
Figure 7:
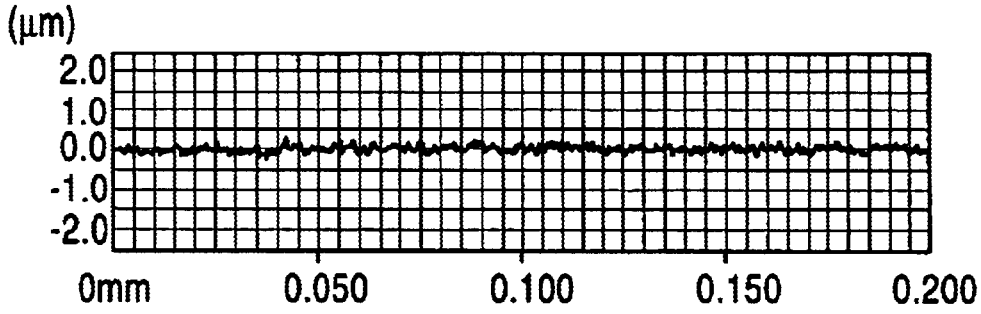

FIG. 7 shows the results of experiments by the surface treatment procedure as described above. As shown in FIG. 7 (A), a probe 29 was moved along inner surface of the flexible tube 1 and surface roughness was measured. FIG. 7 (B) shows the results of measurement before polishing, and surface roughness was about Ry 4 $\mu$m. After the polishing, surface roughness was about Ry 0.3 $\mu$m as shown in FIG. 7(C), and the effectiveness of the present invention has been confirmed.

Figure 6:
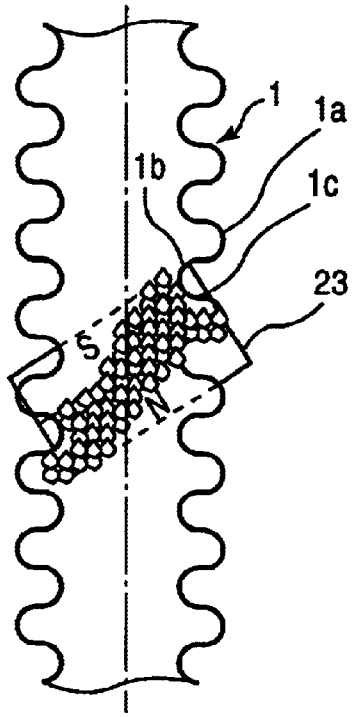
FIG. 6 is a drawing to show another embodiment of the surface treatment method of the present invention.

FIG. 6 shows another embodiment of the surface treatment method of the present invention. In this embodiment, the magnet 23 is arranged in such manner that the magnetic poles N and S are tilted with respect to axial line of the flexible tube 1. As a result, the magnetic grains 27 are attached on the tube wall with a tilt with respect to the axial line of the flexible tube 1, and intermediate zones 1*c* between the troughs 1*a* and the crests 1*b* can be polished with high accuracy.

Figure 12:
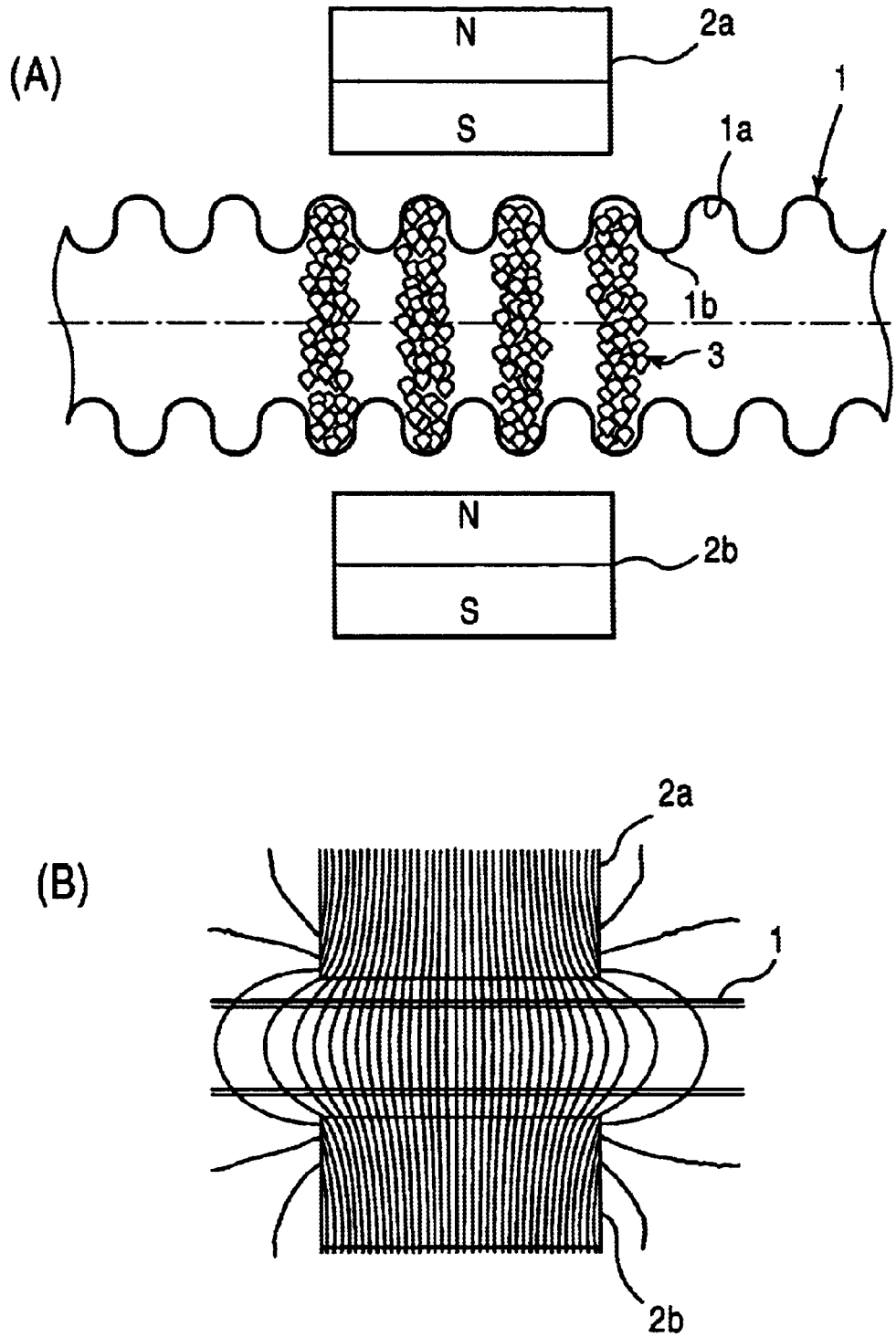
FIG. 12 PRIOR ART
FIG. 12 shows a conventional surface treatment method.
Figure 13:
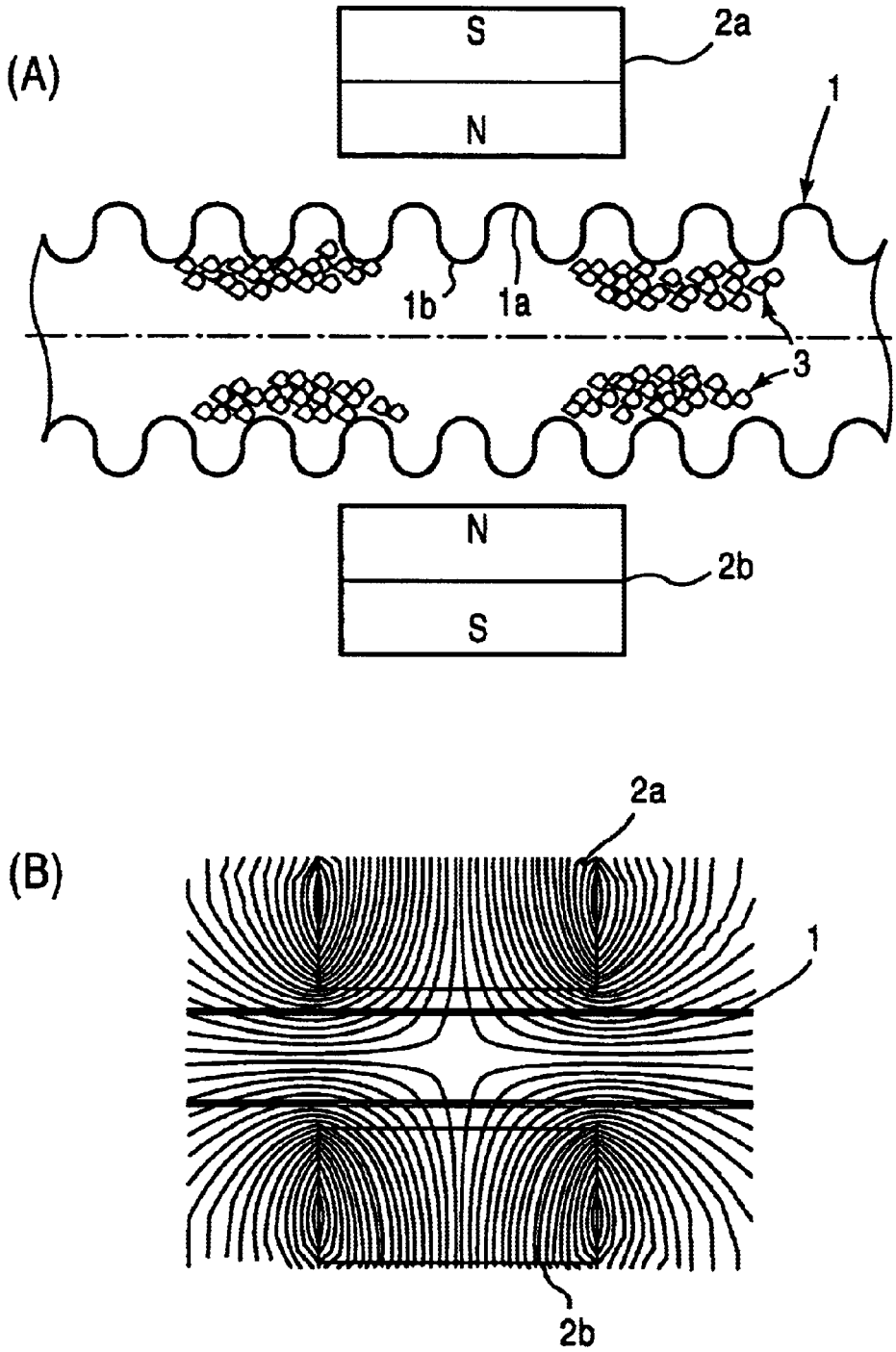
FIG. 13 PRIOR ART
FIG. 13 shows another example of the conventional surface treatment method.

Table 1 summarizes the results of evaluation based on the arrangement of the magnet when tube diameter of the flexible tube 1 is large (tube diameter 19 mm), intermediate (tube diameter 14 mm) and small (tube diameter 9 mm). In this table, N-N magnetic field shows the condition of FIG. 13, N-S magnetic field shows the condition of FIG. 12, single pole magnetic field shows the condition of FIG. 5, and single pole magnetic field (45°) shows the condition of FIG. 6. The mark ○ shows that polished surface is very satisfactory and perfectly complies with the allowable value of Ry 0.7 $\mu$m. The mark Δ shows that surface roughness does not exceed the allowable value of Ry 0.7 $\mu$m. The mark X means that no surface treatment has been accomplished. Based on these results, it is evident that single pole magnetic field according to the present invention gives excellent results. In particular, in small diameter flexible tube, the single pole magnetic field (45°) gives satisfactory results.

TABLE 1

| | N-N magnetic field | N-S magnetic field | Single pole magnetic field | Single pole magnetic field (45°) |
|---|---|---|---|---|
| Tube diameter: large | | | | |
| Crest | ○ | x | Δ | Δ |
| Intermediate zone (crest - trough) | ○ | x | Δ | Δ |
| Trough | ○ | ○ | Δ | Δ |
| Tube diameter: intermediate | | | | |
| Crest | ○ | x | Δ | Δ |
| Intermediate zone (crest - trough) | ○ | x | Δ | Δ |
| Trough | ○ | ○ | Δ | Δ |
| Tube diameter: small | | | | |
| Crest | ○ | x | ○ | ○ |
| Intermediate zone (crest - trough) | x | x | Δ | ○ |
| Trough | x | Δ | ○ | ○ |

FIG. 8 to FIG. 11 each represents other embodiment of the surface treatment apparatus according to the present invention. In the following, the same component is referred by the same symbol, and detailed description is not given here.

Figure 8:
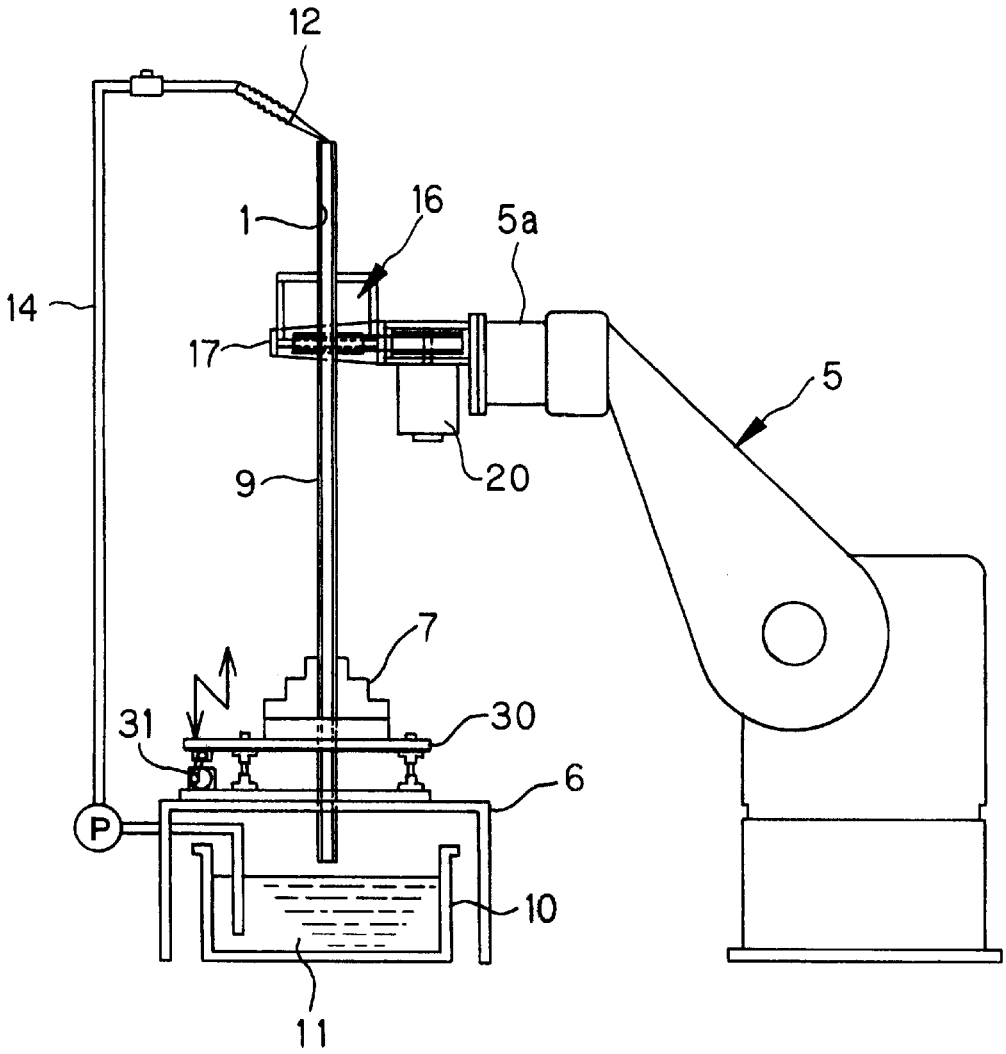
FIG. 8 shows another embodiment of the surface treatment apparatus according to the present invention.

In the embodiment shown in FIG. 8, a vibrator 30 is arranged between the support stand 6 and the fixture 7. The vibrator 30 is vibrated in the arrow direction by a motor 31 for vibration, and the guide pipe 9 and the flexible tube 1 are vibrated.

Figure 9:
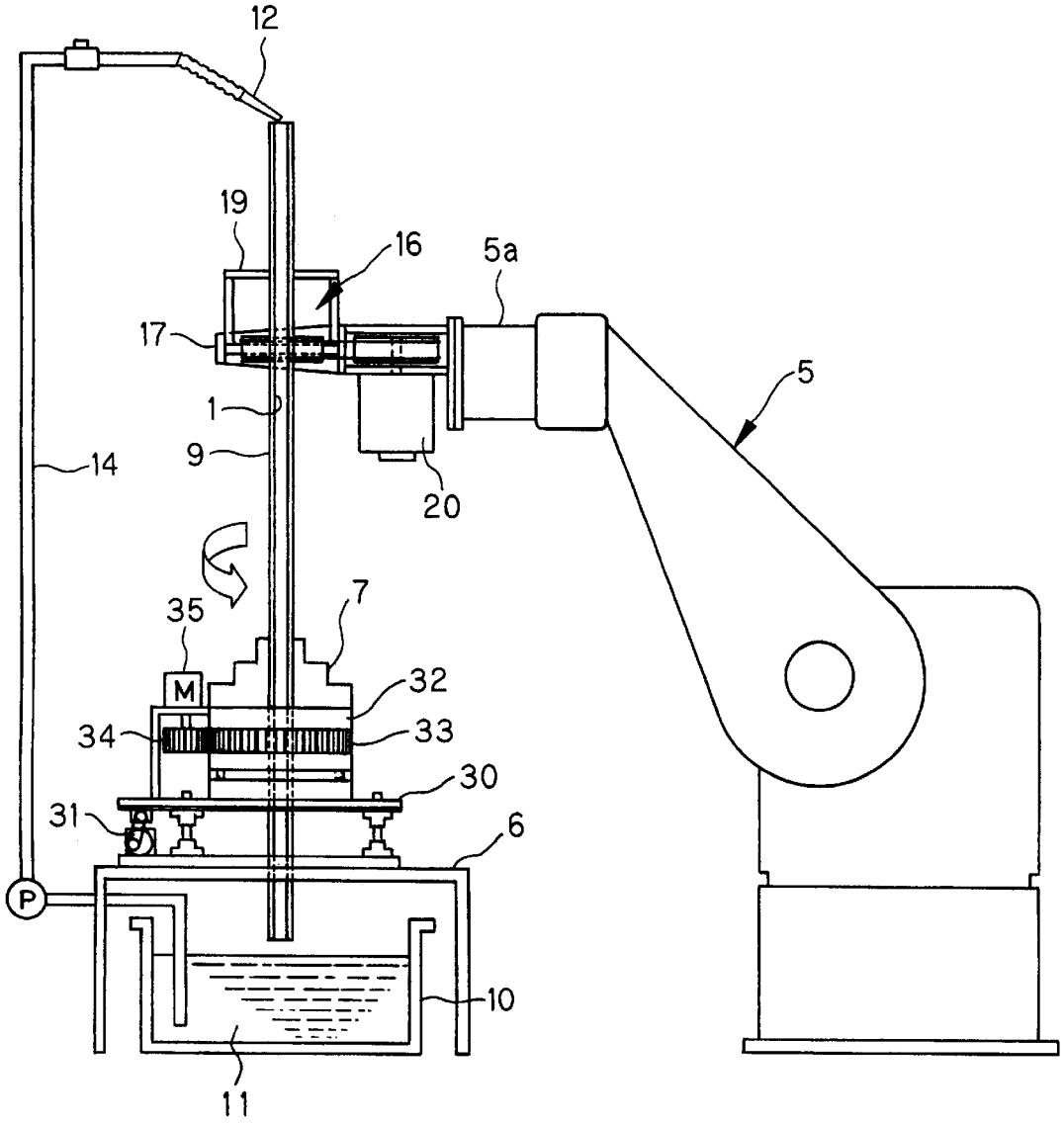
FIG. 9 shows another embodiment of the surface treatment apparatus according to the present invention.

In the embodiment shown in FIG. 9, a rotor 32 is fixed under the fixture 7, and the rotor 32 is rotatably mounted with respect to the vibrator 30. A driven gear 33 is fixed on the rotor 32. Rotation of a motor 35 is transmitted to the driven gear 33 via a driving gear 34 so that the rotor 32, the guide pipe 9, and the flexible tube 1 can be rotated. Number of revolutions of the rotor is set to about 1400 rpm. As a result, unevenness in polishing is decreased. Relative peripheral speed of the workpiece and the tool is increased, thus contributing to the improvement of the fabrication efficiency.

Figure 10:
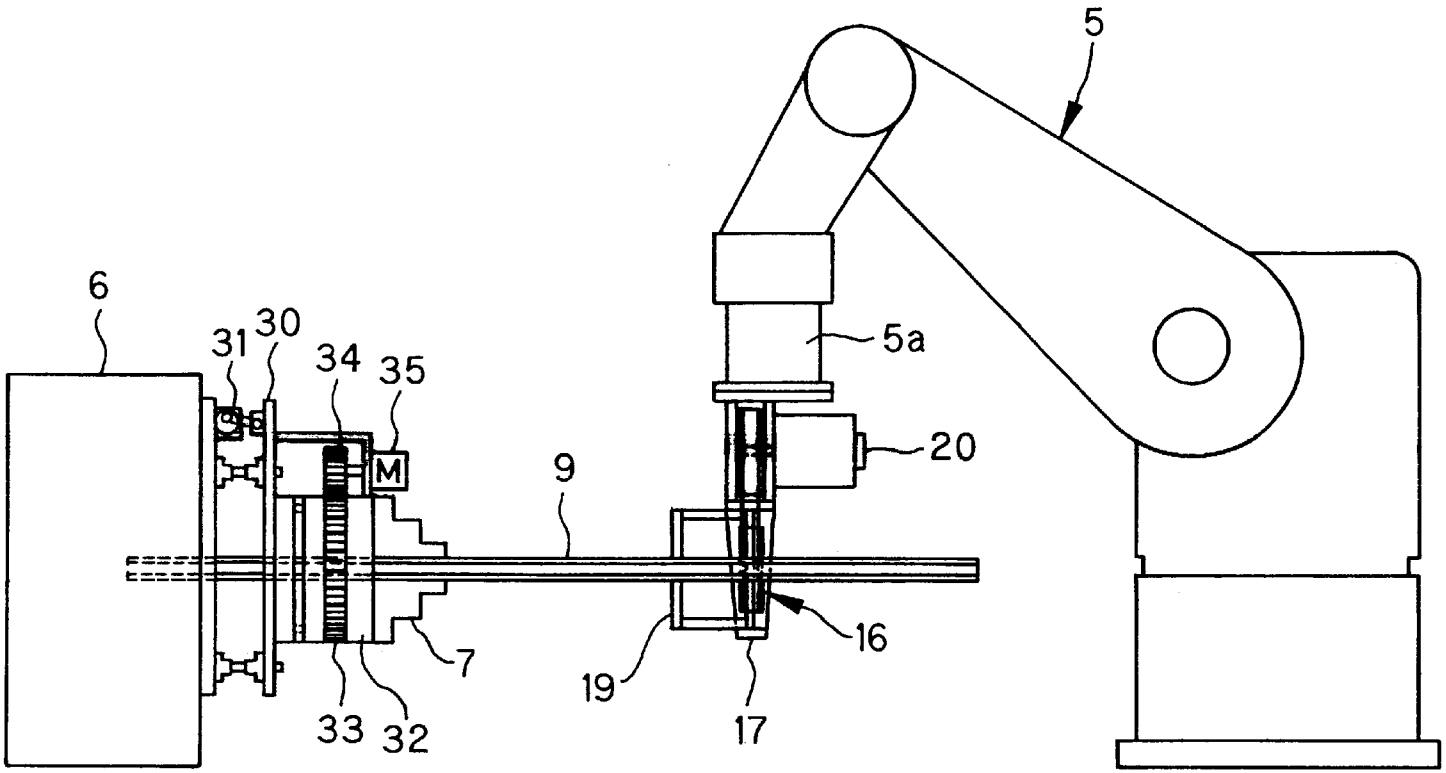
FIG. 10 shows a variation of the embodiment shown in FIG. 9.

FIG. 10 shows a variation of the embodiment of FIG. 9. In this embodiment, the guide pipe 9 is set in horizontal position, and polishing and washing are performed.

Figure 11:
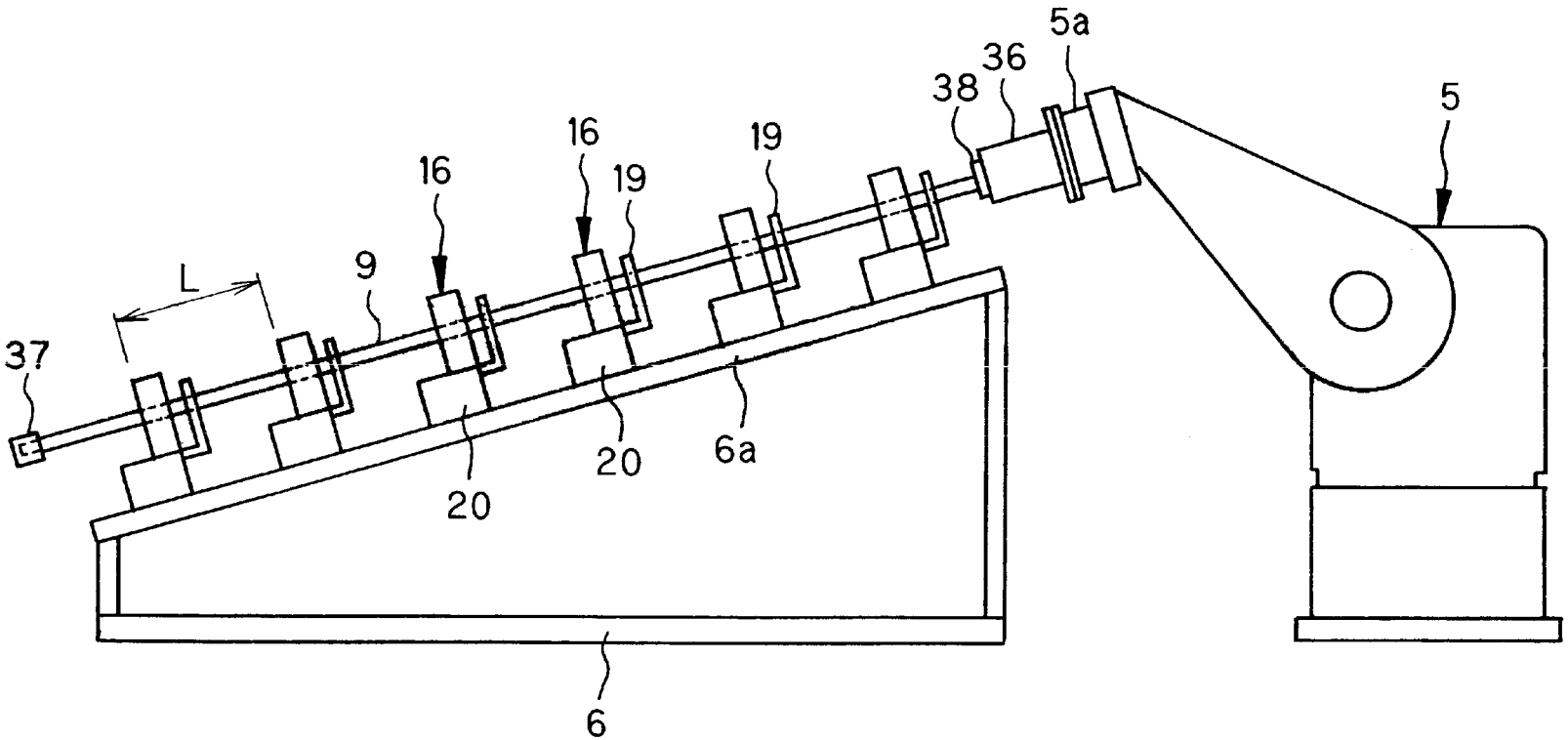
FIG. 11 shows still another embodiment of the surface treatment apparatus according to the present invention.

Description will be given now on the embodiment shown in FIG. 11. On the support stand 6, an inclined surface 6*a* is formed. A plurality of sets of the motors 20 for magnet driving and the magnetic pole units 16 as explained in FIG. 2 are installed on the inclined surface 6*a*. A positioning member 19 as explained in FIG. 1 is arranged on each of the magnetic pole units 16. A motor 36 for pipe driving is mounted on the tip of the arm 5*a* of the robot 5.

The flexible tube is inserted into the guide pipe 9, and magnetic grains and abrasive grains in slurry state are filled into the flexible tube, and lower end of the guide pipe 9 is sealed with a plug 37. Next, the guide pipe 9 is passed through each of the magnetic pole units 16 and the positioning members 19, and upper end of the guide pipe 9 is connected to the motor 36 for pipe driving by means of a connector 38.

The magnet 23 (FIG. 2) is rotated around the guide pipe 9 by the motor 20 for magnet driving. By the motor 36 for pipe driving, the guide pipe 9 is rotated in a direction reverse to the magnet 23 (number of revolutions: approx. 1400 rpm in both cases). When the polishing is completed at a site, the guide pipe 9 is moved in axial direction by the robot 5. In the present embodiment, polishing can be accomplished by simply moving the guide pipe 9 for a distance L between the adjacent magnetic pole units 16, and this contributes to the surface treatment within shorter time.

In the above, description has been given on embodiments of the present invention, while the invention is not limited to these embodiments, and various changes and modifications can be made. For instance, description has been given on surface treatment of a flexible tube in the above embodiments, while the application of the invention is not limited to the flexible tube, and it can be applied to any type of member, which has complicated internal configuration.

As it is evident from the above description, according to the present invention, a magnet is disposed on outer side of a member, which is made of a nonmagnetic material and for which surface treatment is to be performed on its internal surface. Magnetic grains and abrasive grains in slurry state are supplied. By rotating at least one of the member and the magnet and by giving vibration at the same time, inner surface of the member having complicated internal configuration such as a flexible tube can be polished and washed with high accuracy.

What is claimed is:

1. A method for surface treatment of inner surface of a member, comprising the steps of:

arranging a magnet on an outer side of a member, said ember being made of a nonmagnetic material and having an inner surface to be processed by surface treatment, supplying magnetic grains and abrasive grains in slurry state on the inner surface of the member, and rotating and relatively moving in axial direction at the same time at least one of the member and the magnet.

2. A method for surface treatment of inner surface of a member according to claim 1, wherein said member is a flexible tube, and further comprising the step of:

inserting said flexible tube into a guide pipe made of a nonmagnetic material.

3. A method for surface treatment of inner surface of a member according to claim 2, further comprising the step of:

giving vibration to the flexible tube.

4. A method for surface treatment of inner surface of a member according to claim 2, further comprising the step of:

arranging magnetic poles of the magnet in axial direction of the flexible tube.

5. A method for surface treatment of inner surface of a member according to claim 2, further comprising the step of:

positioning the magnetic poles of the magnet with an inclination with respect to axial line of the flexible tube.

6. An apparatus for surface treatment of inner surface of a member, comprising a plurality of sets of motors for magnet driving and magnetic pole units arranged on an inclined surface, a magnet in said magnetic pole unit for being driven by the motor for magnet driving, a positioning member mounted on each of the magnetic pole units, a motor for pipe driving mounted on tip of an arm of a robot, a guide pipe penetrating each of the magnetic pole units and positioning members and connected to the motor for pipe driving, a flexible tube inserted into the guide pipe, and magnetic grains and abrasive grains in slurry state filled in the flexible tube.

7. An apparatus for surface treatment of inner surface of member according to claim 6, wherein said magnet and said guide pipe are rotated in opposite directions respectively.

* * * * *